United States Patent [19]

Flanagan et al.

[11] 3,950,196

[45] Apr. 13, 1976

[54] COOL-BURNING GUN PROPELLANT CONTAINING TRIAMINOQUANIDINE ETHYLENE DINITRAMINE

[75] Inventors: Joseph E. Flanagan, Woodland Hills; Vernon E. Haury, Santa Susana, both of Calif.

[73] Assignee: Rockwell International Corporation, El Segundo, Calif.

[22] Filed: June 14, 1973

[21] Appl. No.: 370,133

[52] U.S. Cl. ..... 149/92; 149/96

[51] Int. Cl.[2] ..... C06B 25/34; C06B 25/18

[58] Field of Search ..... 149/91, 92, 96

[56] References Cited

UNITED STATES PATENTS

| | | | |
|---|---|---|---|
| 2,929,699 | 3/1960 | Audrieth | 149/92 |
| 3,110,258 | 11/1963 | Weber | 149/91 |
| 3,639,183 | 2/1972 | Crescenzo | 149/92 |
| 3,732,130 | 5/1973 | Flanagan | 149/92 |
| 3,732,131 | 5/1973 | Haury | 149/92 |

*Primary Examiner*—Richard D. Lovering
*Assistant Examiner*—Donald P. Walsh
*Attorney, Agent, or Firm*—L. Lee Humphries; Robert M. Sperry

[57] ABSTRACT

A family of gun propellants formulated with triaminoguanidine ethylenedinitramine (TAGED), as an oxidizer, to reduce the isochoric flame temperature while providing high mass impetus.

6 Claims, No Drawings

COOL-BURNING GUN PROPELLANT CONTAINING TRIAMINOQUANIDINE ETHYLENE DINITRAMINE

BACKGROUND OF THE INVENTION

1. Field of the Invention

This invention relates to gun propellants and is particularly directed to gun propellant formulations employing triaminoguanidine ethylenedinitramine as an oxidizer, to provide low isochoric flame temperatures and high mass impetus.

2. Prior Art

For several hundred years, investigators have been seeking to improve firearms and the propellants used in them. Many significant improvements have been made. However, as long as there is a demand for such weapons, the search for improvements will continue. In recent years, automatic guns have been developed which are capable of firing several thousand rounds of ammunition per minute. However, the gun propellants available heretofore have had isochoric flame temperatures in the range of 2400°K to 3300°K. As a result, the barrels of the automatic guns have tended to overheat and become warped quite rapidly. Consequently, it has been necessary to replace the gun barrels frequently, which reduces the effectiveness of such guns and adds considerably to the expense of operating such guns. While some prior art gun propellants are known which have lower flame temperatures, these cool-burning propellants generally also have significantly lower mass impetus.

BRIEF SUMMARY AND OBJECTS OF INVENTION

These disadvantages of the prior art are overcome with the present invention and a family of gun propellants is proposed which provides isochoric flame temperatures 20 to 30 percent lower than those of conventional military propellants, while yielding comparable or higher mass impetus.

The advantages of the present invention are preferably attained by providing gun propellant formulations employing triaminoguanidine ethylenedinitramine (TAGED) as an oxidizer.

Accordingly, it is an object of the present invention to provide improved gun propellants.

Another object of the present invention is to provide gun propellants having flame temperatures which are significantly lower than those of conventional military propellants, while yielding comparable or greater mass impetus.

A specific object of the present invention is to provide gun propellant formulations employing TAGED as an oxidizer.

These and other objects and features of the present invention will be apparent from the following detailed description.

DETAILED DESCRIPTION OF THE INVENTION

In that form of the present invention chosen for purposes of illustration, a family of gun propellants is formulated, employing TAGED as an oxidizer, to provide flame temperatures which are significantly lower than those of conventional military propellants, while yielding comparable or greater mass impetus.

The theoretical performances of standard military propellants, as described in U.S. Army Propellant Manual No. AMCP-706-150, published February 1965, are shown in Table I.

TABLE I

| Propellant | Mass Impetus ft.-lb./lb. | Flame Temperature | Molecular Weight |
|---|---|---|---|
| M-1 | 305,000 | 2417°K | 22.06 |
| M-2 | 360,000 | 3319°K | 25.64 |
| M-10 | 339,000 | 3000°K | 24.58 |
| IMR | 325,000 | 2827°K | 24.17 |

In contrast, propellants formulated with TAGED have yielded mass impetus in the range of 330,000 to 350,000, with flame temperatures in the range of 2100°K to 2300°K.

EXAMPLE I

In accordance with the present invention, a gun propellant was formulated consisting of 75% by weight of TAGED, 24.5% by weight of nitrocellulose, and 0.5% by weight of ethyl centralite. This propellant was fired in a 20 mm Mann gun and yielded the data shown in Table II.

TABLE II

| | |
|---|---|
| Charge Weight | 11.01 grams |
| Grain Dimensions (inches) | 0.375 × 0.115 × 0.020 |
| Peak Pressure | 35,300 psi |
| Muzzle Velocity | 1,740 ft./sec. |
| Velocity Efficiency | 90.5% |
| Isochoric Flame Temperature | 2123°K |
| Molecular Weight | 17.78 |
| Specific Impulse | 332,000 ft.-lbs./lb. |

EXAMPLE II

A gun propellant was formulated consisting of 55% by weight of TAGED, 20% by weight of cyclotetramethylene tetranitramine, 10% by weight of ethyl cellulose, and 15% by weight of trimetholethane trinitrate. This propellant yielded an isochoric flame temperature of 2118°K, a mass impetus of 331,200 ft.-lb/lb., and a molecular weight of 17.78. After seven days' storage at 75°C, no degratation of the propellant was observed.

EXAMPLE III

A gun propellant was formulated consisting of 65% by weight of TAGED, 10% by weight of cyclotetramethylene tetranitramine, 24.5% by weight of nitrocellulose, and 0.5% by weight of ethyl centralite. This yielded an isochoric flame temperature of 2273°K, a mass impetus of 349,200 ft.lb./lbs., and a molecular weight of 18.09.

EXAMPLE IV

A gun propellant was formulated consisting of 58.5% by weight of TAGED, 21.5% by weight of cyclotetramethylene tetranitramine, 17.5% by weight of nitrocellulose, and 2.5% by weight of isodecyl pelargonate. This propellant yielded an isochoric flame temperature of 2264°K, a mass impetus of 350,600 ft.-lbs./lb., and a molecular weight of 17.97.

EXAMPLE V

A gun propellant was formulated consisting of 40.0% by weight of TAGED, 37.5% by weight of cyclotetramethylene tetranitramine, 12.5% by weight of nitrocellulose, 4.0% by weight of isodecyl pelargonate, and 6.0% by weight of ethyl cellulose. This propellant yielded an isochoric flame temperature of 2214°K, a mass impetus of 338,700 ft.-lbs./lb., and a molecular weight of 18.18.

A technique for producing TAGED is disclosed in the *Journal of Organic Chemistry*, Volume 32, p.289 (1967). Obviously, numerous variations and modifications may be made without departing from the present invention. Accordingly, it should be clearly understood that the forms of the present invention described above are illustrative only and are not intended to limit the scope of the present invention.

What is claimed is:

1. A gun propellant consisting of about 75% by weight of triaminoguanidine ethylenedinitramine, about 24.5% by weight of nitrocellulose, and about 0.5% by weight of ethyl centralite.

2. A gun propellant consisting of about 55% by weight of triaminoguanidine ethylenedinitramine, about 20% by weight of cyclotetramethylene tetranitramine, about 10% by weight of ethyl cellulose, and about 15% by weight of trimethylolethane trinitrate.

3. A gun propellant consisting of about 65% by weight of triaminoguanidine ethylenedinitramine, about 10% by weight of cyclotetramethylene tetranitramine, about 24.5% by weight of nitrocellulose, and about 0.5% by weight of ethyl centralite.

4. A gun propellant consisting of about 58.5% by weight of triaminoguanidine ethylenedinitramine, about 21.5% by weight of cyclotetramethylene tetranitramine, about 17.5% by weight of nitrocellulose, and about 2.5% by weight of isodecyl pelargonate.

5. A gun propellant consisting of about 40.0% by weight of triaminoguanidine ethylenedinitramine, about 37.5% by weight of cyclotetramethylene tetranitramine, about 12.5% by weight of nitrocellulose, about 4.0% by weight of isodecyl pelargonate, and about 6.0% by weight of ethyl cellulose.

6. A gun propellant, consisting of about 35% to 80% by weight of triaminoguanidine ethylenedinitramine, about 0% to 40% by weight of cyclotetramethylene tetranitramine, about 10% to 25% by weight of nitrocellulose, and about 0% to 10% by weight of isodecyl pelargonate.

* * * * *